United States Patent [19]

Sasaki et al.

[11] 4,236,053

[45] Nov. 25, 1980

[54] PUFFER TYPE GAS CIRCUIT BREAKER

[75] Inventors: Koji Sasaki; Yoshihito Asai, both of Hitachi, Japan

[73] Assignee: Hitachi, Ltd., Japan

[21] Appl. No.: 937,804

[22] Filed: Aug. 29, 1978

[30] Foreign Application Priority Data

Sep. 2, 1977 [JP] Japan ..... 52-104812

[51] Int. Cl.[3] ..... H01H 33/70

[52] U.S. Cl. ..... 200/144 R; 200/148 A

[58] Field of Search ..... 200/148 R, 148 A, 148 B, 200/148 C, 148 D, 147 E, 148 F, 148 G, 148 H, 148 J, 148 BV, 144 R, 150 G

[56] References Cited

U.S. PATENT DOCUMENTS 3,941,962 3/1976 Thaler ..... 200/148 A 4,131,775 12/1978 Meyer et al. ..... 200/148 R

*Primary Examiner*—J. V. Truhe

*Assistant Examiner*—Morris Ginsburg

*Attorney, Agent, or Firm*—Craig and Antonelli

[57] ABSTRACT

A puffer type gas circuit breaker in which a stationary arcing contact constituting the stationary part of a breaking unit is surrounded by an envelope including an annular shield element acting to relieve the electric field around the free end of the stationary arcing contact, and a gas passage extending in the axial direction of the stationary arcing contact is formed in the side portion of the envelope so that the greater portion of an arc extinguishing gas puffed toward the stationary arcing contact can be discharged through the gas passage. In the circuit breaker, a gas-shielding hood is disposed around the envelope for preventing the gas stream discharged from the gas passage from flowing directly straight.

22 Claims, 13 Drawing Figures

PUFFER TYPE GAS CIRCUIT BREAKER

This invention relates to a puffer type gas circuit breaker, and more particularly to a circuit breaker of the type in which means are provided for preventing an undesirable deterioration of the dielectric strength due to an arc extinguishing gas flowing past a stationary arcing contact after having acted upon an arc during the circuit breaking operation.

A puffer type gas circuit breaker comprises a breaking unit disposed within a metal vessel maintained at, for example, the ground potential level and filled with an arc extinguishing gas of suitable pressure. This breaking unit includes a pair of arcing contacts generating an arc thereacross during their relative parting movement, and a gas compressing assembly for compressing the arc extinguishing gas in response to the relative parting movement of the arcing contacts. The arc extinguishing gas compressed by the compressing assembly is guided by an insulator nozzle to be directed toward the stationary arcing contact and flows then toward the inner wall surface of the metal vessel. The arc extinguishing gas having acted upon the arc is substantially ionized due to its high temperature and is thus susceptible to dielectric breakdown at a relatively low electric field intensity compared with its normal state. It is therefore important for the puffer type gas circuit breaker to suitably process the arc extinguishing gas flowing toward the inner wall surface of the metal vessel after having acted upon the arc.

Sufficient attention has not been directed hitherto to the processing of the arc extinguishing gas having acted upon the arc in the case of a puffer type gas circuit breaker housed within a metal vessel having a large internal volume. This is because the breaking unit in such a puffer type gas circuit breaker is spaced apart from the inner wall surface of the metal vessel of large internal volume by a radial distance which is enough to form a wide gas space therebetween. Due to the presence of such a wide gas space, the arc extinguishing gas having acted upon the arc and ionized due to the high temperature is cooled by the fresh gas existing in this gas space and recovers its dielectric strength before it reaches the inner wall surface of the metal vessel. However, when it is desired to decrease the diameter of the metal vessel for reducing the overall size of the puffer type gas circuit breaker, the radial distance between the breaking unit and the metal vessel is correspondingly decreased to such an extent that the arc extinguishing gas having acted upon the arc cannot sufficiently recover its dielectric strength or insulation resistance before it reaches the inner wall surface of the metal vessel.

Sufficient attention is not paid to the above problem in a conventional puffer type gas circuit breaker. Fortunately, indeed, an electric-field relieving shield element is disposed in the vicinity of the stationary arcing contact for relieving the electric field around the free end of the stationary arcing contact, and since this shield element is located between the stationary arcing contact and the metal vessel, it acts to deflect a portion of the arc extinguishing gas having acted upon the arc. However, the aforementioned problem has not been basically solved by the presence of such a shield element due to the fact that this shield element is designed to have a shape and occupy a position most suitable for relieving the electric field in view of its primary service.

A proposal intended to solve the aforementioned problem is described in U.S. Pat. No. 3,941,962. This U.S. patent discloses an improved puffer type gas circuit breaker which comprises a reversing hood located between the stationary arcing contact and the metal vessel. A cylinder is concentrically disposed between the stationary arcing contact and the reversing hood. This cylinder is open merely at its axial ends and is completely closed at its peripheral side. The stationary arcing contact is hollow, and a plurality of apertures are formed in the side wall of its root portion. The major portion of the arc extinguishing gas having acted upon the arc flows into the cylinder, thence, through the apertures of the contact into the reversing hood to be cooled by the reversing hood. Therefore, no gas stream is substantially formed which flows directly toward the inner wall surface of the metal vessel. However, such a path for the arc extinguishing gas stream flowing toward and into the reversing hood is not preferable for the circuit breaking performance of the circuit breaker which must handle a very large current. That is, although the gas is forced to flow through the apertures of small diameter formed in the root portion of the stationary arcing contact, the gas having its pressure abruptly increased due to contact with the arc is encountered with a great resistance at the apertures of the stationary arcing contact resulting in substantial pressure build-up within the cylinder. Although the apertures of the stationary arcing contact are designed to have a largest possible diameter to avoid the pressure build-up within the cylinder, this leads inevitably to a reduction in the mechanical strength of the stationary arcing contact. Further, the end of the cylinder associated with the free end of the stationary arcing contact serves as a shield means for relieving the electric field around the free end of the stationary arcing contact, and thus, the diameter of the cylinder is selected to be smallest withn an allowable range in order to improve the electric field relieving effect. In such a cylinder, abrupt pressure build-up occurs within a short time due to the flow thereinto of the gas having acted upon the arc. This adversely affects the supply of fresh gas which must act upon the arc jumping across the stationary and movable arcing contacts, resulting in a reduced circuit breaking performance and also in a reduction in the dielectric strength between the arcing contacts. One of the serious defects of the proposed puffer type gas circuit breaker is that the arc extinguishing gas stream directed from the insulator nozzle toward the stationary arcing contact is deflected by the reversing hood. More precisely, the arc extinguishing gas having acted upon the arc flows into the reversing hood and flows out after having its flowing direction reversed toward the gap between the stationary and movable arcing contacts. The arc extinguishing gas having contributed to the extinction of the arc includes decomposition products tending to deteriorate its dielectric strength, and the gas stream having its flowing direction reversed is extremely objectionable for the maintenance of the required insulation between the stationary and movable arcing contacts.

Japanese Patent Application Kokai (Laid-Open) No. 53-8779 discloses a puffer type gas circuit breaker having a structure similar to that disclosed in U.S. Pat. No. 3,941,962 cited above. This puffer type gas circuit breaker fails also to obviate the aforementioned defect.

It will be understood from the above description that the arc extinguishing gas having contributed to the arc extinction must be suitably processed so as not to adversely affect the required insulation between the stationary and movable arcing contacts for the realization of the desired reduction in the size of the metal vessel of the circuit breaker.

It is therefore an object of the present invention to provide a puffer type gas circuit breaker in which the size of the metal vessel containing the breaking unit is considerably reduced.

Another object of the present invention is to provide a puffer type gas circuit breaker which can operate with an improved circuit breaking performance by the provision of additional means for reducing the size of the metal vessel.

Still another object of the present invention is to provide a puffer type gas circuit breaker in which the means added for reducing the size of the metal vessel are not impaired during assembling.

The present invention, which attains the above objects, provides a puffer type gas circuit breaker in which a stationary arcing contact constituting the stationary part of a breaking unit disposed is surrounded by an envelope including an annular shield element acting to relieve the electric field around the free end of the stationary arcing contact; a gas passage extending in the axial direction of the stationary arcing contact is formed in the side portion of the envelope so that the greater portion of an arc extinguishing gas puffed toward the stationary arcing contact can be discharged through the gas passage; and a gas-shielding hood is disposed around the envelope for preventing the gas stream discharged from the gas passage from flowing directly straight. Therefore, the ionized high-temperature gas having acted upon the arc may sufficiently be cooled in the gas-shielding hood to recover its dielectric strength, so that the radial distance between the metal vessel and the breaking unit can be reduced to the value which is determined depending on the intensity of the electric field between the metal vessel and the gas-shielding hood to provide a small-sized gas circuit breaker having a reduced internal volume. Further, the formation of the gas passage in the side portion of the envelope provides such an additional advantage that no pressure build-up which will obstruct the smooth flow of the arc extinguishing gas does not occur in the vicinity of the stationary arcing contact.

The above and other objects, features and advantages of the present invention will become more apparent from the following detailed description of preferred embodiments thereof taken in conjunction with the accompanying drawings, in which.

Figure 1:
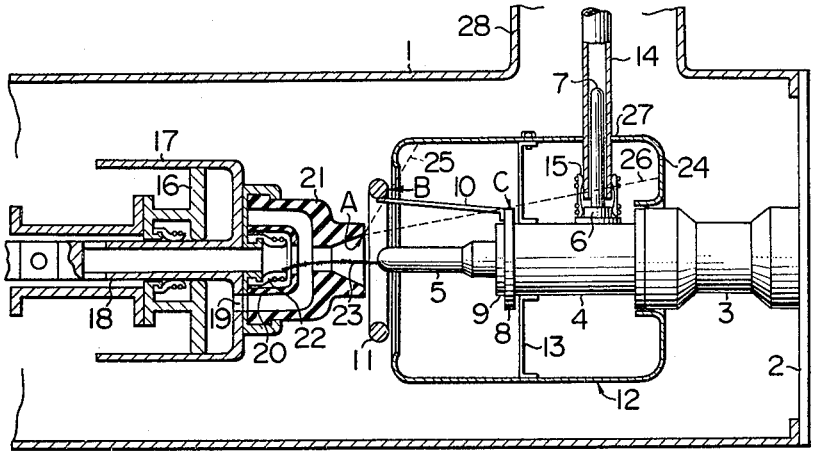
FIG. 1 is a longitudinal sectional view showing the structure of an embodiment of the puffer type gas circuit breaker according to the present invention.

FIG. 1 shows an embodiment of the puffer type gas circuit breaker of the present invention in its circuit breaking position. Referring to FIG. 1, the puffer type gas circuit breaker comprises a breaker unit disposed within a metal vessel 1 having an arc extinguishing gas such as $SF_6$ gas filled in its internal space. An insulator 3, a connection conductor 4 and a stationary arcing contact 5 are connected in the above order within the metal vessel 1, with the insulator 3 connected at its right-hand end to the inner surface of a cover 2 sealing the axial end opening of the metal vessel 1. A branch conductor 6 and a guide rod 7 are connected to the peripheral wall of the connection conductor 4 to extend in a direction orthogonal with respect to the axis of the stationary arcing contact 5, and a flange 8 is formed at the left-hand end of the connection conductor 4. The stationary arcing contact 5 is provided with a seat 9 at the right-hand end connected to the left-hand end of the connection conductor 4, and this seat 9 is fixed by bolts to the flange 8 to support the stationary arcing contact 5 on the connection conductor 4. At least one strip conductor 10 is connected at one end thereof to the flange 8, and a shield ring 11 for the electric-field relieving purpose is fixed to the other end of the strip conductor 10 at substantially the same position as the free end of the stationary arcing contact 5. The shield ring 11 acts to prevent undesirable concentration of the electric field in the area around the free end of the stationary arcing contact 5 during the circuit breaking operation, since this shield ring 11 is connected by the strip conductor 10 to the stationary arcing contact 5 and is thus maintained at the same potential level as that of the stationary arcing contact 5. A gas-shielding hood 12 is arranged to surround the strip conductor 10 and connection conductor 4 and is fixed to the connection conductor 4 by means of at least one strip conductor 13 to be supported by the connection conductor 4. The guide rod 7 is received in the internal space of a hollow conductor 14 which is electrically connected by a current collector 15 to the branch conductor 6 branched from the connection conductor 4. The conductor 14 is a central conductor of a bushing connected to, for example, a cylindrical branch 28 of the metal vessel 1 and connects one of the terminals of the breaking unit to the external circuit. The stationary side of the breaking unit has a structure as above described.

The movable side of the breaking unit has a structure as described presently. A piston 16 of annular shape is fixed in position by an insulator not shown. A cylinder 17 engages slidably at its inner peripheral face with the outer peripheral face of the piston 16 and has its central shaft 18 slidably engaging with the inner peripheral face of the piston 16. These elements constitute a gas compressing assembly. More precisely, leftward movement of the central shaft 18 of the cylinder 17 takes place during the circuit breaking operation of the breaking unit thereby comprising the arc extinguishing gas existing in the space defined between the piston 16 and the cylinder 17. This compressed arc extinguishing gas is puffed through an aperture 19 of the cylinder 17 to flow through a gas passage formed by a flow guide 20 and a nozzle 21 of insulator. The flow guide 20 is fixed to the cylinder 17 and surrounds a movable arcing contact 22 which is supported by contact 34 at its center portion. Contact 34 is in turn fixed to cylinder 17 by means of bolts (not shown). The insulator nozzle 21 is also fixed to the cylinder 17 and surrounds the flow guide 20. This insulator nozzle 21 is formed with an orifice having a smallest diameter substantially equal to that of the stationary arcing contact 5. In the circuit making position of the breaking unit, the stationary arcing contact 5 is in electrical contact with the movable arcing contact 22 while sealing the orifice of the insulator nozzle 21. An arc 23 jumps across the stationary and movable arcing contacts 5 and 22 when these contacts are parted relative to each other due to the leftward movement of the central shaft 18 of the cylinder 17. The compressed arc extinguishing gas flows through the gas passage defined between the flow guide 20 and the insulator nozzle 21 to be puffed from the orifice of the insulator nozzle 21 toward the stationary arcing contact 5 to act upon the arc 23 until finally the arc 23 is completely extinguished to complete the circuit breaking operation.

The aforementioned gas-shielding hood 12 is provided for processing the arc extinguishing gas after having acted upon the arc 23. The structure and function of this gas-shielding hood 12 will now be described in detail.

The gas-shielding hood 12 may be constituted by a member of insulator or metal or by an integral connection of such members. In the embodiment being described, this hood 12 has a hollow cylindrical shape of right circuit section except its axial end portions and is made of a metal, preferably, stainless steel, aluminum, copper or the like having a high coefficient of thermal expansion. The gas-shielding hood 12 is maintained at the same potential level as that of the stationary arcing contact 5 since it is electrically connected by the strip conductor 13 to the stationary arcing contact 5. The gas-shielding hood 12 includes a gas shielding surface which intercepts straight flow of the arc extinguishing gas in a hollow cylindrical region spread out like an unfolded fan and represented by straight lines 25 and 26 when the arcing contacts 5 and 22 are parted to be substantially spaced apart from each other by the distance required for the arc extinction. The straight line 25 connects between the tip A of the orifice of the insulator nozzle 21 and the inner periphery B of the shield ring 11, and the straight line 26 connects between the tip A of the orifice of the insulator nozzle 21 and the outer periphery C of the flange 8 and extends toward the right-hand end of the gas-shielding hood 12. The shape of the cylindrical region represented by these straight lines 25 and 26 varies depending on the operating position of the movable parts of the breaking unit.

The conditions for setting these straight lines 25 and 26 will now be discussed. Generally, the time at which the arc is completely extinguished varies depending on the value of current handled by the circuit breaker. However, the arc extinguishing gas starts to flow toward the stationary arcing contact 5 after the stationary arcing contact 5 has been disengaged from the orifice of the insulator nozzle 21, and this provides a first condition. During the subsequent parting movement of the movable arcing contact 22 relative to the stationary arcing contact 5, the arc extinguishing gas continues to flow toward the stationary arcing contact 5. Generally, the movable parts of the breaking unit are moved beyond the parting distance required for the arc extinction until they are shifted to the position required for maintaining the insulation between the two arcing contacts 5 and 22. Thus, the moving distance of the movable parts of the breaking unit until at least the arc is extinguished, provides a second condition. The time of arc extinction is preferably experimentally determined since it varies depending on the rated capacity of the circuit breaker and also on the structure of the breaking unit. In the first condition, it is unnecessary to take into account the flow of arc extinguishing gas toward the left relative to the puffing end of the insulator nozzle 21. This is because the arc extinguishing gas is supplied from the compressing assembly to be puffed through the insulator nozzle 21, and no gas stream toward the left will be formed even when the pressure may be transmitted toward the left relative to the puffing end of the insulator nozzle 21.

It will be seen in FIG. 1 that the left-hand end of the gas-shielding hood 12 is put back slightly toward the downstream of the arc extinguishing gas, namely rightward in the drawing, from the shield ring 11 and has a curved surface which is bent toward the central axis of the hood 12. The right-hand end wall of the gas-shielding hood 12 terminates in the vicinity of the left-hand end of the insulator 3 and is then turned in over the insulator 3 to provide a turned-in portion 24 which is spaced by a slight gap from the outer periphery of the insulator 3. The inner diameter of the gas-shielding hood 12 is preferably so selected that the space between it and the outer periphery of the flange 8 provides a small resistance against the arc extinguishing gas stream. However, when the diameter of flange 8 is selected to be excessively small to meet this requirement, the gas-shielding hood 12 will require an excessively large axial length in order that the aforementioned relation can be satisfied. Thus, the gas-shielding hood 12 is formed with a turned-in portion 24 as illustrated or is subjected to deep drawing to provide the gas-shielding surface against the gas stream portion flowing along the straight line 26. This turned-in portion 24 serves to prevent an excessive increase in the axial length of the gas-shielding hood 12, and at the same time, its outwardly convex curved contour exhibits an electricfield relieving effect. Thus, this gas-shielding hood 12 is in the form of a vessel which is substantially closed at the downstream end with respect to the flowing direction of the arc extinguishing gas. However, the gas-shielding hood 12 may be formed with an opening such as a lead-out opening 27 for the conductor 14.

The presence of such an opening is allowable in the gas-shielding hood 12 for the reasons described presently. In the breaking unit of this kind, since the braking unit includes the compressing assembly which compresses the arc extinguishing gas in response to the circuit breaking operation, the arc extinguishing gas having acted upon the arc 23 would flow toward the inner wall surface of the metal vessel 1 if there were provided with no gas-shielding hood 12. The temperature of the gas having acted upon the arc 23 would be elevated, and its dielectric strength would be lowered, resulting in deterioration of, for example, the dielectric strength between the shield ring 11 and the metal vessel 1. Consequently, the recovery voltage having its peak value appearing in about several hundred μsec to several m sec after the extinction of the arc 23 would provide a cause of flashover trouble occurring between the shield ring 11 and the metal vessel 1. However, such a flashover trouble does not occur since the arc extinguishing gas having its temperature elevated by acting upon the arc 23 is shielded by the gas-shielding hood 12 from flowing directly straight toward the inner wall surface of the metal vessel 1 during at least the period of time in which the peak value of the recovery voltage appears. Therefore, even when a gas stream flowing toward the inner wall surface of the metal vessel 1 from the gas-shielding hood 12 may be produced after the appearance of the peak value of the recovery voltage, the gas has been sufficiently cooled and has its dielectric strength recovered during the above period of time. Thus, the presence of an opening which may produce such a gas stream is allowable. Formation of such an opening in the vicinity of the path of the arc 23 would not still cause a flashover trouble since the gas is cooled by contact with the gas-shielding hood 12 and has its dielectric strength restored, provided that the gas-shielding hood 12 is so constructed that it does not permit flow of the gas directly straight toward the inner wall surface of the metal vessel 1. Provided that the selected conditions above specified are satisfied such an opening can therefore be formed in the gas-shielding hood 12 and the gas-shielding hood 12 may be axially divided into a plurality of sections.

The pressure build-up within the gas-shielding hood 12 can be more effectively suppressed in an embodiment described later. The internal volume of the gas-shielding hood 12 of vessel-like form in the embodiment shown in FIG. 1 is selected to be equal to or larger than the internal volume of the compressing chamber in the compressing assembly, that is, the internal volume of the chamber defined by the piston 16 and cylinder 17. Therefore, even when the gas-shielding hood 12 is filled with the arc extinguishing gas of high temperature and high pressure having acted the upon arc 23, the gas does not flow backward toward the movable side of the breaking unit from the opening in the left-hand end of the hood 12 at about the time of appearance of the peak value of the recovery voltage. In other words, no flashover trouble occurs between the shield ring 11 or hood 12 and the metal vessel 1 due to the backward flow of the gas. The backward flow of the gas toward the movable side of the breaking unit is also prevented by the bleeding of the gas from the right-hand end of the gas-shielding hood 12. Such an effect is obtained by the positional relation between the breaking unit and the gas-shielding hood 12. More precisely, the above effect is obtained by so determining the relative positions of the gas-shielding hood 12 and the breaking unit that the arc extinguishing gas flows into the gas-shielding hood 12 from the left-hand end thereof. This effect is further enhanced by suitably determining the position of the gas-shielding hood 12 relative to that of the stationary arcing contact 5. That is, the gas-shielding hood 12 has an end which is located downstream with respect to the flowing direction of the gas relative to the seat 9 of the stationary arcing contact 5. Thus, the gas-shielding hood 12 defines a gas space around the connection conductor 4. This gas space acts to effectively retard the build-up of pressure in the area in the vicinity of the stationary arcing contact 5, and at the same time, to effectively establish a gas stream flowing from the left-hand end toward the right-hand end of the gas-shielding hood 12. The gas can flow in that direction without being encountered with any substantial resistance due to the fact that the gas-shielding hood 12 is secured to the connection conductor 4 by the strip conductor 13. The pressure build-up within the gas-shielding hood 12 is further prevented by the discharge of the gas through, for example, the opening 27, and since the gas is stored in the gas-shielding hood 12 for a time enough to be cooled down and has its dielectric strength recovered substantially, such a gas stream directed from the interior of the gas-shielding hood 12 toward the inner wall surface of the metal vessel 1 would not give rise to any practical problem.

In the arrangement shown in FIG. 1, it should be noted that the internal volume of the gas-shielding hood 12 may be smaller than that of the compressing chamber in the compressing assembly. This is because a gap is formed between the shield ring 11 and the left-hand end of the gas-shielding hood. Of course, this gap acts to discharge the gas which has been cooled by touching the gas-shielding hood, out of the gas-shielding hood so as to prevent the internal pressure of the gas-shielding hood from increasing. This construction makes it possible to reduce the diameter of the gas-shielding hood and/or reduce the area of the flow path between the flange 8 and the gas-shielding hood to some extent, so that the diameter of the vessel 1 may also be reduced. Further, although the left-hand end of the gas-shielding hood 12 is put back slightly from the shield ring 11, with respect to the gas flow, it may be regarded as if the left-hand end of the gas-shielding hood 12 and the shield ring were overlapped and therefore the left end of the gas-shielding hood may be protected against the hot gas. Thus, the gas-shielding hood 12 may be maintained in a good condition in view of the electric field. Further, since the shield ring 11 is slightly projected from the frontal or free end of the stationary arcing contact 5, it is possible to always improve the potential distribution at the left-hand end of the stationary arcing contact 5, avoiding the influence of the hot gas to the left-hand end of the shield ring 11.

Thus, the shield ring 11 can be disposed at the best position for relieving the electric field, and the gas-shielding hood 12 prevents the straight flow of the gas toward the metal vessel 1 and cooperates at one of its axial ends with the shield ring 11 to exhibit the electric-field relieving effect. One of the reasons for the exhibition of the electric-field relieving effect is that the end of the cylindrical gas-shielding hood 12 nearer to the movable parts of the breaking unit projects toward the movable side of the breaking unit beyond the cylindrical branch 28 extending from the metal vessel 1. The metal vessel 1 and the gas-shielding hood 12 have opposed portions which define a zone which is parallel to the axis of the metal vessel 1, and the electric field in this zone is approximately uniform. In the circuit breaking position of the circuit breaker, the distribution of equipotential lines between the stationary and movable arcing contacts 5 and 22 is such that these equipotential lines are orthogonal with respect to the equipotential lines in the zone above described. Consequently, slight disturbance or non-uniformity occurs in the potential distribution in the area in the vicinity of the shield ring 11 at which these two groups of equipotential lines join. The same applies to the area in the vicinity of the cylindrical branch 28 branched from the metal vessel 1. Therefore, the parallel opposite portions of the metal vessel 1 and gas-shielding hood 12 cooperate to provide the zone which separates the area of non-uniform potential distribution thereby alleviating the mutual interference.

The electric-field relieving action of the gas-shielding hood 12 will be understood from the above description. Therefore, deformation of the gas-shielding hood 12 must be positively avoided. Two considerations are provided in the present embodiment for preventing deformation of the gas-shielding hood 12.

According to the first consideration, the strip conductor 13 supporting the gas-shielding hood 12 is disposed at a position which is nearer to the movable side of the breaking unit than the center of the axial length of the gas-shielding hood 12. This arrangement prevents the gas-shielding hood 12 from being vibrated by the pressure of the gas flowing into the hood 12. The gas-shielding hood 12 cooperates with the shield ring 11 to maintain the desirable state in the area in the vicinity of the stationary and movable arcing contacts 5 and 22 to which the greatest attention must be paid in the circuit breaker of this type. Therefore, even when the gas-shielding hood 12 is axially divided into a plurality of sections spaced apart by a gap, the divided sections are preferably mechanically firmly connected to each other.

According to the second consideration, the current collector 15 is used for the electrical connection between the conductor 14 and the connection conductor 4, and the conductor 14 is constructed in the form of, for example, a tubular body having a recess or axial bore in the lower end for receiving therein the guide rod 7 extending through the gas-shielding hood 12. This arrangement permits electrical contact between the conductor 14 and the current collector 15 by being guided by the guide rod 7, and thus, protects the gas-shielding hood 12 from being damaged by the conductor 14 during insertion of the conductor 14.

In a practical application of the circuit breaker according to the first embodiment of the present invention, the right-hand end of the gas-shielding hood 12 may be sandwiched between the connection conductor 4 and the insulator 3. Further, the conductor 14 may be mechanically connected to the connection conductor 4 by bolts. Furthermore, the stationary side of the breaking unit may be supported by various other structures than that illustrated. For example, the insulator 3 may be eliminated, and a bar-shaped insulator may be fixed at one end thereof to the piston 16 in the movable parts of the breaking unit and may extend over the outer periphery of the cylinder 17 to terminate at the other end thereof within the gas-shielding hood 12 so that the connection conductor 4 can be fixed to the other end of this bar-shaped insulator.

Figure 2:
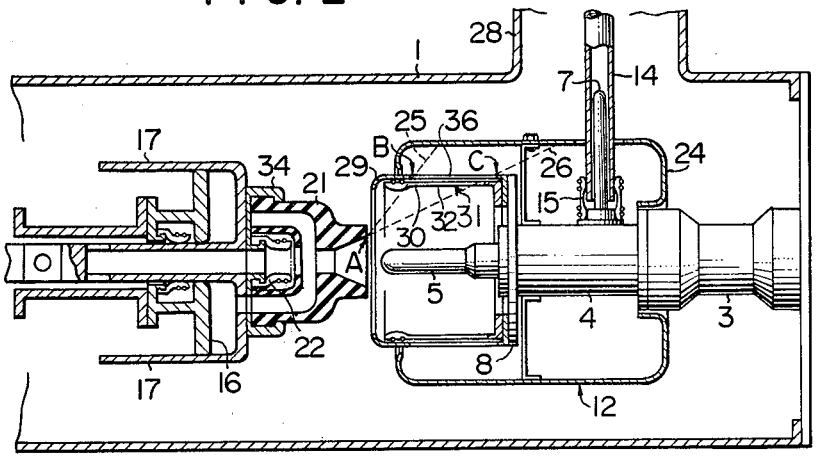
FIG. 2 is a longitudinal sectional view showing the structure of another embodiment of the puffer type gas circuit breaker according to the present invention.
Figure 3:
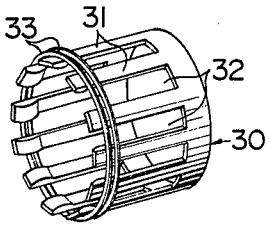
FIG. 3 is a perspective view of the stationary main contact shown in FIG. 2.
Figure 4:
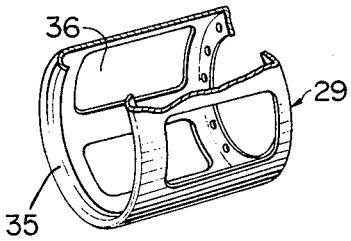
FIG. 4 is a partly cut-away perspective view of the shield sleeve shown in FIG. 2.

Another embodiment of the present invention is shown in FIG. 2. In this embodiment, the shield ring 11 shown in FIG. 1 is replaced by a shield sleeve 29. Fixed to the flange 8 of the connection conductor 4 is a cylindrical stationary main contact 30 including a plurality of circumferentially equally spaced contact fingers 31 surrounding the stationary arcing contact 5. As best shown in FIG. 3, the contact fingers 31 of this stationary main contact 30 define therebetween a plurality of slots 32 providing discharge apertures for the arc extinguishing gas. Springs 33 impart a contact pressure to these contact fingers 31 so that these fingers 31 can make electrical contact with a movable main contact 34 shown in FIG. 2. This movable main contact 34 is parted from the stationary main contact 30 prior to the relative parting movement between the stationary and movable arcing contact 5 and 22. The shield sleeve 29 surrounds the stationary main contact 30 and is fixed to the flange 8 of the connection conductor 4. As best shown in FIG. 4, the shield sleeve 29 has an annular curved end wall 35 corresponding to the shield ring 11 shown in FIG. 1 and includes a plurality of gas discharge slots or apertures 36 in the area corresponding to the slots 32 of the stationary main contact 30 shown in FIG. 3. Thus, the stationary arcing contact 5 is enveloped by a conductive envelope. The gas discharge apertures 32 of the stationary main contact 30 and the gas discharge apertures 36 of the shield sleeve 29 constituting the conductive envelope cooperate to provide a gas passage permitting flowing of the arc extinguishing gas from the interior to the exterior of the conductive envelope across its peripheral wall. This gas passage has a predetermined length in the axial direction of the stationary arcing contact 5.

The embodiments shown in FIGS. 1 and 2 have such a common feature that a conductive envelope is provided which includes an annular shield element for relieving the electric field in the vicinity of the free end of the stationary arcing contact 5 opposite to the associated end of the movable arcing contact 22. That is, the strip conductor 10 shown in FIG. 1 corresponds to the portions obtained by increasing the circumferential width of the apertures 36 of the shield sleeve 29 shown in FIG. 4. Further, since the left-hand end of the shield sleeve 29 is projected from the free end of the stationary arcing contact 5 and the left-hand end of the gas-shielding hood 12 is located in the vincinity of the boundary portion between the apertures 36 and the annular curved end wall 35 which is formed at the left-hand end of the shield sleeve 29 as shown in FIG. 4, the slots formed in the stationary main contact 30 may be actively used as gas passages. The function of the gap formed between the shield sleeve 29 and the left-hand end of the gas-shielding hood 12 is the same as that described in connection with the embodiment of FIG. 1. In the case of the embodiment shown in FIG. 1, the shield ring 11 is supported by the strip conductor 10. This arrangement may thus be regarded as a conductive envelope formed in its peripheral wall with a gas passage having the same length as that of the strip conductor 10.

In the conductive envelope disposed around the stationary arcing contact 5 shown in FIG. 2, the gas passage formed in the peripheral wall of the conductive envelope in the axial direction of the stationary arcing contact 5 may have a large area. The arc extinguishing gas puffed from the orifice of the insulator nozzle 21 flows into the conductive envelope with a diverging flow pattern which is determined by the relation between the shape of the orifice of the insulator nozzle 21 and the associated end of the stationary arcing contact 5. However, such a gas stream enters the gas-shielding hood 12 after being smoothed while flowing through the gas passage of the conductive envelope. Therefore, no pressure build-up occurs in area in the vicinity of the stationary arcing contact 5, and the gas puffing effect can be enhanced even when the conductive envelope has a small diameter. It is the presence of the gas-shielding hood 12 that permits such smooth flow of the gas through the conductive envelope. The conductive envelope in the embodiment shown in FIG. 2 exhibits the same electric-field relieving effect as that described with reference to FIG. 1 when it is maintained at the same potential level as that of the stationary arcing contact 5.

The axial length and position of the gas-shielding hood 12 shown in FIG. 2 are determined under the same conditions as those discussed with reference to the embodiment shown in FIG. 1. Thus, in this second embodiment too, the straight line 25 connecting between the tip A of the orifice of the insulator nozzle 21 and the left-hand end B of the gas passage of the conductive envelope is presumed, and then, the straight line 26 connecting between the tip A of the orifice of the insulator nozzle 21 and the right-hand end C of the gas passage of the conductive envelope is further presumed. The gas-shielding hood 12 is constructed to include a gas-shielding surface which intercepts straight flow of the arc extinguishing gas in a hollow cylindrical region represented by the straight lines 25 and 26.

Each of the gas-shielding hoods 12 shown in FIGS. 1 and 2 may have its gas-shielding surface partly omitted. This is because the left-hand end of the gas-shielding hood 12 terminates in the vicinity of the left-hand end of the conductive envelope, and therefore, the arc extinguishing gas flowing into the gas-shielding hood 12 acts to draw fresh gas existing around the insulator nozzle 21. The fresh gas thus drawn provides a shielding effect for the flow of the gas having acted upon the arc 23 so that the gas stream having acted upon the arc 23 can be positively directed toward and into the gas-shielding hood 12.

Figure 12:
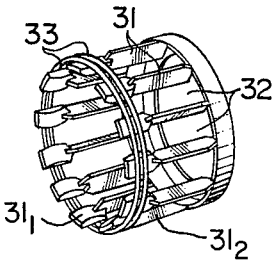
FIGS. 12 and 13 are perspective views of other forms of stationary and main contact shown in FIG. 3.
Figure 13:
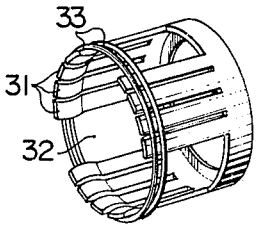

The number of the contact fingers 31 shown in FIG. 3 varies depending on the current conduction capacity of the circuit breaker. When the circuit breaker is designed to conduct a large current value, the contact fingers 31 defining the slots 32 therebetween are shaped into a form as shown in FIG. 12. It will be seen in FIG. 12 that each of the circumferentially spaced contact fingers 31 has an inwardly expanded contact portion $31_1$ and another portion $31_2$ corresponding to the apertures 36 of the annular shield 29. The portion $31_2$ has a radial thickness larger than its circumferential width. Each individual contact finger 31 is fabricated by machine cutting and has its body portion crossing at an angle of 90° with its end portions, or such a contact finger is provided by twisting the opposite end portions of a strip workpiece through an angle of 90° with respect to the body portion. When the circuit breaker is designed to conduct a relatively small current value, the contact fingers 31 are divided into a plurality of groups, and the circumferential distance between the groups is selected to be larger than that between the contact fingers 31 in each group, as shown in FIG. 13. Further, when the circuit breaker has the relatively small current conduction capacity, the stationary main contact 30 and the gas-shielding hood 12 may be disposed in eccentric relation, and the gas discharge apertures 32 may be concentrated in the portion of the stationary main contact 30 which is spaced by the larger distance from the opposite portion of the gas-shielding hood 12 than the remaining portion.

Figure 5:
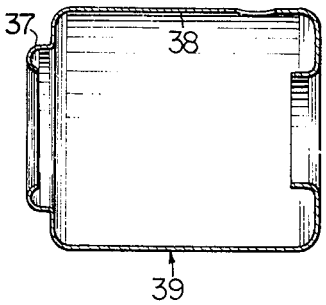
FIGS. 5 and 6 are longitudinal sectional views of other forms of the gas-shielding hood shown in FIG. 2.

FIG. 5 shows another gas-shielding hood structure. The gas-shielding hood 39 shown in FIG. 5 is actually an integral combination of the shield sleeve 29 and gas-shielding hood 12 shown in FIG. 2. This gas-shielding hood 39 includes a small-diameter first cylindrical portion 37 at one end opposite to the movable side of the breaking unit and a large-diameter second cylindrical portion 38 at the other end remote from the removable side of the breaking unit. These two cylindrical portions 37 and 38 are integrally formed by, for example, deep drawing, or are integrally connected by, for example, welding. Such an integral structure of the hood 39 facilitates the mounting work such that the hood 39 can be simply mounted in position in the circuit breaker, and prevents the relative positions of the shield ring 11 and hood 12 shown in FIG. 1 from being varied by the pressure of the arc extinguishing gas flowing into the gas-shielding hood 39.

Figure 6:
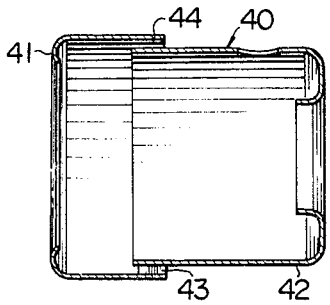

FIG. 6 shows another gas-shielding hood structure. The gas-shielding hood 40 shown in FIG. 6 includes a large-diameter first cylindrical member 41 at one end opposite to the movable side of the breaking unit and a small-diameter second cylindrical member 42 at the other end remote from the movable side of the breaking unit. These two cylindrical members 41 and 42 are partly overlapped for defining a gap between the overlapped portions, and a plurality of spacers 43 are disposed in this gap to mechanically connect these two cylindrical members 41 and 42. These spacers 43 defines a gas passage 44 therebetween. The arc extinguishing gas of high temperature and high pressure having acted upon the arc enters the gas-shielding hood 40, and part of the gas is discharged through the gas passage 44. The gas flowing through the gas passage 44 is cooled by contact with the members having a high coefficient of thermal expansion forming the gas passage 44, and at the same time, the gas is prevented from directly flowing toward the inner wall surface of the metal vessel 1. Since the gas discharged from the gas passage 44 does not adversely affect the insulation between the metal vessel 1 and the gas-shielding hood 40, undesirable pressure build-up within the hood 40 is restrained, and backward flow of the gas from within the hood 40 does not occur.

Figure 7:
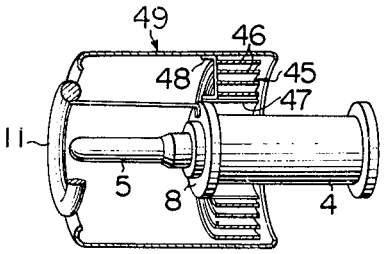
FIG. 7 is a perspective view of part of still another embodiment of the puffer type gas circuit breaker according to the present invention.

FIG. 7 shows part of another embodiment or a modification of the first embodiment of the circuit breaker according to the present invention, which includes a gas-shielding hood 49 having a reduced axial length. A cooling unit 45 is disposed in the right-hand end of the gas-shielding hood 49 and includes at least one cooling ring 46 disposed concentrically between the connection conductor 4 and the hood 49, and supporting members 47 and 48 fixedly supporting the cooling ring 46 on the connection conductor 4. The supporting member 48 serves also to fix the gas-shielding hood 49 to the connection conductor 4. The cooling ring 46 functions in a manner similar to the gas passage 44 shown in FIG. 6 and also provides part of the straight line 26 shown in FIG. 1. Thus, the axial length of the gas-shielding hood 49 can be reduced compared with the gas-shielding hood 12 shown in FIG. 1.

Figure 8:
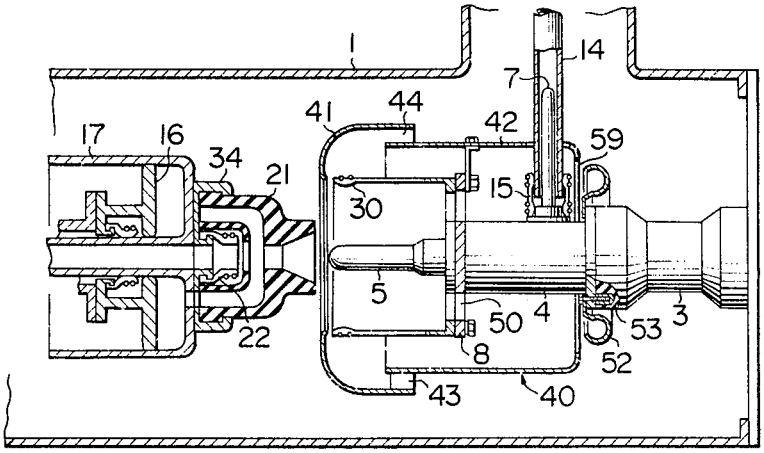
FIGS. 8 and 9 are longitudinal sectional views showing the structure of other embodiments of the puffer type gas circuit breaker according to the present invention.
Figure 9:
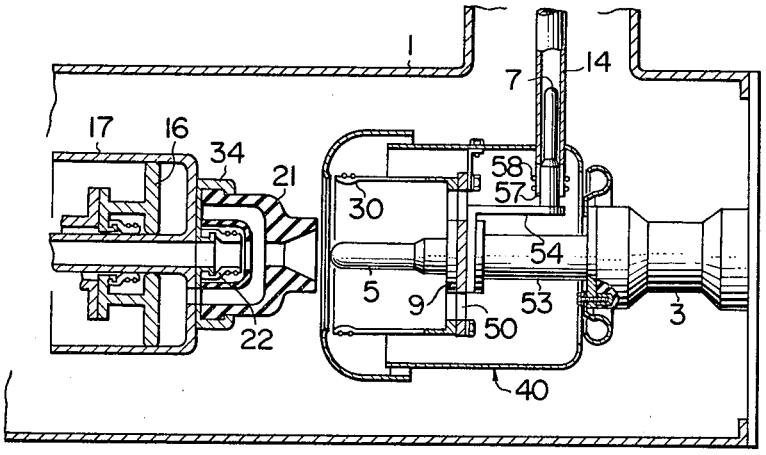
Figure 10:
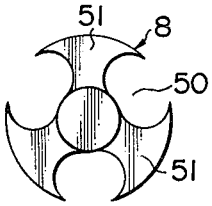
FIG. 10 is a front elevational view of the flange shown in FIG. 8.
Figure 11:
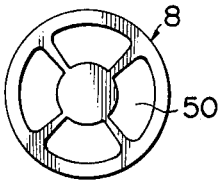
FIG. 11 is a front elevational view of a modification of the flange shown in FIG. 8.

Modifications of the second embodiments of the present invention including improved breaking units are shown in FIGS. 8 and 9. The breaking unit shown in FIG. 8 is featured by the fact that axial communication ports 50 are provided in the flange 8 of the connection conductor 4. The embodiment shown in FIG. 8 includes a gas-shielding hood 40 which is generally similar to that shown in FIG. 6, and a large opening 59 is formed in the right-hand end of the second cylindrical member 42. As shown in FIG. 10, the flange 8 includes three radially extending arms 51 which define the communication ports 50 therebetween. Further, as shown in FIG. 11, the flange 8 may be such that throughholes are bored in a disc to provide the communication ports 50. By virtue of the provision of such communication ports 50, the arc extinguishing gas supplied to the vicinity of the stationary arcing contact 5 can quickly move without stagnating in that area. This is apparent from comparison with the embodiment shown in FIG. 2 in that the provision of the communication ports 50 reduces the portion of the gas stream impinging against the flange 8. An additional gas-shielding hood 52 is fixedly mounted on the left-hand end of the insulator 3 so that the arc extinguishing gas discharged from the communication ports 50 may not reduce the dielectric strength or insulation resistance of the insulator 3 against creeping discharge. This additional gas-shielding hood 52 has the same function as that of the turned-in portion 24 of the gas-shielding hood 12 shown in FIG. 1 in that it acts to shield the gas from flowing directly straight toward the inner wall surface of the metal vessel 1 and to alleviate disturbance or non-uniformity caused in the electric field due to the presence of fixtures 53 embedded in the insulator 3 for mechanical connection between the insulator 3 and the connection conductor 4. To this end, the gas-shielding hood 52 is fixed to the connection conductor 4 to be maintained at the same potential level as that of the connection conductor 4 and is shaped into an annular form having a curved surface projecting toward the insulator 3.

The pressure discharge path 44 formed between the gas-shielding hoods 41 and 42 corresponds to the gap formed between the shield ring 11 and the left-hand end of the gas-shielding hood 12 in the embodiment of FIG. 1 and the gap formed between the shield sleeve 29 and the left-hand end of the gas-shielding hood 12 in the embodiment of FIG. 2 and functions in the same manner as described in connection with these gaps of FIG. 1 and FIG. 2.

The embodiment shown in FIG. 9 is featured by the fact that the connection conductor 4 fixedly connecting the stationary arcing contact 5 to the insulator 3 is divided into a mechanical-strength providing member 53 and an electrically conductive member 54. The electrically conductive member 54 provides the electrical connection between the stationary arcing contact 5 and the conductor 14 and also between the stationary main contact 30 and the conductor 14 and is sandwiched at its root portion between the mechanical-strength providing member 53 and the seat 9 of the stationary arcing contact 5. The mechanical-strength providing member 53 participates merely in providing the required mechanical strength and has thus a small outer diameter. Therefore, a gas space of large volume is defined between the gas-shielding hood 40 and the mechanical-strength providing member 53 and can be effectively utilized for the cooling of the arc extinguishing gas and for the suppression of pressure build-up within the gas-shielding hood 40. The guide rod 7 which acts also as a current conductor is connected to the electrically conductive member 54 and is received in the hollow space of the conductor 14. A plurality of axial slits 57 are formed in the connected end of the conductor 14, and a spring 58 wound around this end portion of the conductor 14 presses the slitted end of the conductor 14 against the associated portion of the guide rod 7 to ensure the electrical connection between the conductor 14 and the guide rod 7. The current collector is formed integrally with the conductor 14 to further increase the volume of the gas space defined within the gas-shielding hood 40. Other elements are similar to those in the embodiment shown in FIG. 8.

Although the metal vessel 1 is maintained at the ground potential level in all the embodiments above described, a suitable impedance may be connected between the metal vessel 1 and ground, or the potential level of the metal vessel 1 may be the same as that of the movable arcing contact 22 to obtain the effects entirely similar to those above described.

What is claimed is:

1. A puffer type gas circuit breaker comprising:

a metal vessel filled with an arc extinguishing gas;

a pair of a stationary arcing contact and a movable arcing contact disposed within said metal vessel for making axial parting movement relative to each other;

compressing means disposed within said metal vessel for compressing the arc extinguishing gas in response to the relative parting movement of said stationary and movable arcing contacts;

an insulator nozzle disposed within said metal vessel and having an orifice, for guiding the compressed arc extinguishing gas puffed from said compressing means toward said stationary arcing contact through said orifice which has been disengaged from said stationary arcing contact, during the circuit breaking operation;

a shield ring substantially enveloping the free end of said stationary arcing contact and being maintained at the same potential level as that of said stationary arcing contact;

a strip conductor for fixedly connecting said shield ring to the root portion of said stationary arcing contact and for forming gas passage means directed to said root portion from an end portion of said shield ring facing said root portion;

gas-shielding hood means disposed external to said gas passage means, for shielding the gas stream from flowing directly straight toward the inner surface of said metal vessel after the gas having been puffed from the orifice of said insulator nozzle and passed through said gas passage means; and a gap formed between a frontal end of said gas-shield means and said shield ring for communicating the inner side of said gas-shield means with the outside of the same.

2. A puffer type gas circuit breaker as claimed in claim 1, wherein said shield ring is arranged such that the frontal end of said shield ring projects slightly from the free end of said stationary contact, and wherein said gas passage means is formed from an end of said shield ring located downstream with respect to the flowing direction of said arc extinguishing gas toward the further downstream of the same.

3. A puffer type gas circuit breaker as claimed in claim 1, wherein the internal volume of said gas-shielding hood means is selected to be larger than that of said compressing means when said compressing means is not energized to compress the arc extinguishing gas.

4. A puffer type gas circuit breaker as claimed in claim 1, wherein said gas-shielding hood means includes a curved surface formed at the free end thereof and maintained substantially at the same potential level as that of said shield ring, so that the potential distribution at the free end of said stationary arcing contact is improved by the cooperation of said shield ring and said curved surface.

5. A puffer type gas circuit breaker as claimed in claim 1, wherein said gas-shielding hood means has a cylindrical configuration which is open at an end portion thereof located downstream with respect to the flowing direction of said arc extinguishing gas and includes gas cooling means provided in said end portion thereof so that said end portion thereof is open through said cooling means.

6. A puffer type gas circuit breaker as claimed in claim 1, wherein said gas-shielding hood means includes a gas shielding surface in a cylindrical region defined by straight lines connecting between the tip of the orifice of said insulator nozzle opposite to said stationary arcing contact and each of the opposite axial ends of said gas passage means respectively when said stationary and movable arcing contacts are parted relative to each other by the distance substantially required for the arc extinction.

7. A puffer type gas circuit breaker comprising:

a metal vessel filled with an arc extinguishing gas;

a pair of a stationary arcing contact and a movable arcing contact disposed within said metal vessel for making axial parting movement relative to each other;

compressing means disposed within said metal vessel for compressing the arc extinguishing gas in response to the relative parting movement of said stationary and movable arcing contacts;

an insulator nozzle disposed within said metal vessel and having an orifice, for guiding the compressed arc extinguishing gas puffed from said compressing means toward said stationary arcing contact through said orifice which has been disengaged from said stationary arcing contact during the circuit breaking operation;

main contact means including a movable main contact and a stationary main contact which are arranged so that they make parting movement relative to each other in advance of the parting movement of said stationary and movable arcing contacts, said movable main contact being disposed around said insulator nozzle and said stationary main contact being disposed around said stationary arcing contact and having a plurality of contact fingers formed substantially on the same circumference;

a shield sleeve enveloping said stationary main contact and having at its free end an annular curved end wall for improving the potential distribution of said stationary arcing contact;

a plurality of gas discharge apertures formed between the adjacent ones of said contact fingers;

gas passage means formed in the side portions of said shield sleeve substantially corresponding to said gas discharge apertures except for said annular curved end wall; and gas shielding hood means for shielding the gas stream from flowing directly straight toward the inner wall surface of said metal vessel after the gas having been puffed from the orifice of said insulator nozzle and passed through said gas passage means, said gas-shielding hood means being disposed in a manner so that the end thereof located upstream with respect to the flowing direction of said arc extinguishing gas is retreated from said shield sleeve and positioned near the side portion of said gas passage means of said shield sleeve located upstream with respect to the flowing direction of said arc extinguishing gas.

8. A puffer type gas circuit breaker as claimed in claim 7, wherein each of said plurality of circumferentially spaced contact fingers has an inwardly expanded contact portion and a portion, other than said expanded contact portion, having a radial thickness larger than its circumferential width.

9. A puffer type gas circuit breaker as claimed in claim 7, wherein said plurality of circumferentially spaced contact fingers are divided into a plurality of groups each including a plurality of contact fingers, and said groups are spaced from each other by a distance larger than the distance between adjacent two of the contact fingers in each group.

10. A puffer type gas circuit breaker as claimed in claim 7, wherein said stationary arcing contact and said stationary main contact are fixedly supported by a supporting member having a surface extending orthogonal with respect to the central axis of said stationary arcing contact, and said supporting member is formed with a communication port extending therethrough in the axial direction of said stationary arcing contact.

11. A puffer type gas circuit breaker comprising: P1 a metal vessel filled with an arc extinguishing gas;

a pair of a stationary arcing contact and a movable arcing contact disposed within said metal vessel for making axial parting movement relative to each other;

compressing means disposed within said metal vessel for compressing the arc extinguishing gas in response to the relative parting movement of said stationary and movable arcing contacts;

an insulator nozzle disposed within said metal vessel and having an orifice, for guiding the compressed arc extinguishing gas puffed from said compressing means toward said stationary arcing contact through said orifice which has been disengaged from said stationary arcing contact, during the circuit breaking operation;

a conductor extending outward through said metal vessel in a direction orthogonal with respect to the central axis of said stationary arcing contact;

means for electrically connecting said conductor to said stationary arcing contact;

envelope means including annular shield means for substantially enveloping at least the free end of said stationary arcing contact, said shield means being maintained at the same potential level as that of said stationary arcing contact;

gas passage means formed in the side portion of said envelope means;

gas-shielding hood means for shielding the gas stream from flowing directly straight toward the inner surface of said metal vessel after the gas having been puffed from the orifice of said insulator nozzle and passed through said gas passage means;

a guide rod fixed to said stationary arcing contact and extending to the exterior of said gas-shielding hood means through a leadout opening of said gas-shielding hood means to which said conductor can be inserted; and said conductor being formed at least at its inner end with a recess for receiving said guide rod therein.

12. A puffer type gas circuit breaker as claimed in claim 11, wherein said connecting means includes a plurality of contact pieces formed by a plurality of slits extending axially from the end portion of said conductor at which said recess is formed; and spring means for imparting a biasing force to said contact pieces thereby electrically connecting said contact pieces of said conductor to a conductive root portion of said guide rod.

13. A puffer type gas circuit breaker comprising:
a generally cylindrical metal vessel filled with an arc extinguishing gas;
a pair of a stationary arcing contact and a movable arcing contact disposed within said metal vessel for making axial parting movement relative to each other;
compressing means disposed within said metal vessel for compressing the arc extinguishing gas in response to the relative parting movement of said stationary and movable arcing contacts;
an insulator nozzle disposed within said metal vessel and having an orifice, for guiding the compressed arc extinguishing gas puffed from said compressing means toward said stationary arcing contact through said orifice which has been disengaged from said stationary arcing contact, during the circuit breaking operation;
a cylindrical branch extending outward from said metal vessel in a direction orthogonal with respect to the central axis of said metal vessel;
a conductor extending to the exterior of said metal vessel through said cylindrical branch;
means for electrically connecting said conductor to said stationary arcing contact;
envelope means including annular shield means for substantially enveloping at least the free end of said stationary arcing contact, said shield means being maintained at the same potential level as that of said stationary arcing contact;
gas passage means formed in the side portion of said envelope means; and
gas-shielding hood means for shielding the gas stream from flowing directly straight toward the inner surface of said metal vessel after the gas having been puffed from the orifice of said insulator nozzle and passed through said gas passage means, said gas-shielding hood means being maintained at the same potential level as that of said stationary arcing contact and having one end axially protruding toward said movable arcing contact beyond said cylindrical branch.

14. A puffer type gas circuit breaker comprising:
a metal vessel filled with an arc extinguishing gas;
a pair of a stationary arcing contact and a movable arcing contact disposed within said metal vessel for making axial parting movement relative to each other;
compressing means disposed within said metal vessel for compressing the arc extinguishing gas in response to the relative parting movement of said stationary and movable arcing contacts;
an insulator nozzle disposed within said metal vessel and having an orifice, for guiding the compressed arc extinguishing gas puffed from said compressing means toward said stationary arcing contact through said orifice which has been disengaged from said stationary arcing contact, during the circuit breaking operation;
envelope means including annular shield means substantially enveloping at least the free end of said stationary arcing contact, said shield means being maintained at the same potential level as that of said stationary arcing contact;
gas passage means formed in the side portion of said envelope means; and
gas-shielding hood means for shielding the gas stream from flowing directly straight toward the inner surface of said metal vessel after the gas having been puffed from the orifice of said insulator nozzle and passed through said gas passage means, said gas-shielding hood means including a first cylindrical member having a larger diameter and a second cylindrical member having a smaller diameter with said first cylindrical member being disposed upstream relative to said second cylindrical member with respect to the flowing direction of the arc extinguishing gas, said first and second cylindrical members being partly axially overlapped at their associated end portions thereby defining in the overlapped area a pressure discharge passage communicating with the interior and exterior of said gas-shielding hood means.

15. A puffer type gas circuit breaker comprising:
a metal vessel filled with an arc extinguishing gas;
a pair of a stationary arcing contact and a movable arcing contact disposed within said metal vessel for making axial parting movement relative to each other;
compressing means disposed within said metal vessel for compressing the arc extinguishing gas in response to the relative parting movement of said stationary and movable arcing contacts;
an insulator nozzle disposed within said metal vessel and having an orifice, for guiding the compressed arc extinguishing gas puffed from said compressing means toward said stationary arcing contact through said orifice which has been disengaged from said stationary arcing contact, during the circuit breaking operation;
envelope means including annular shield means for substantially enveloping at least the free end of said stationary arcing contact, said shield means being maintained at the same potential level as that of said stationary arcing contact;
gas passage means formed in the side portion of said envelope means;
gas-shielding hood means for shielding the gas stream from flowing directly straight toward the inner surface of said metal vessel after the gas having been puffed from the orifice of said insulator nozzle and passed through said gas passage means; and
means for fixing said gas-shielding hood means to a member mechanically connected to said stationary arcing contact, said fixing means being disposed within said gas-shielding hood means at a portion biased toward the upstream side of the flowing direction of the arc extinguishing gas relative to the center of the axial length of said gas-shielding hood means.

16. A puffer type gas circuit breaker comprising:
a metal vessel filled with an arc extinguishing gas;
an insulator disposed within said metal vessel and fixed at one end thereof to the inner surface of said metal vessel;
supporting means fixed to the other end of said insulator;
a stationary arcing contact fixedly supported by said supporting means within said metal vessel;
a movable arcing contact disposed within said metal vessel for making axial parting movement relative to said stationary arcing contact;
compressing means disposed within said metal vessel for compressing the arc extinguishing gas in response to the relative parting movement of said stationary and movable arcing contacts;

an insulator nozzle disposed within said metal vessel and having an orifice, for guiding the compressed arc extinguishing gas puffed from said compressing means toward said stationary arcing contact through said orifice which has been disengaged from said stationary arcing contact in response to the circuit breaking operation;

first gas-shielding hood means disposed around said stationary arcing contact and having an opening in the end opposite to said insulator; and second gas-shielding hood means fixed in a position in the vicinity of the connection between said supporting means and said insulator for protecting said insulator against creeping discharge caused by the arc extinguishing gas discharged from said opening of said first gas-shielding hood means.

17. A puffer type gas circuit breaker as claimed in claim 16, wherein said supporting means is fixed to said insulator by screw means making screw threaded engagement with fixtures embedded in said insulator, and said second gas-shielding hood means includes a curved surface axially spaced apart by a gap from the adjacent external surface of said insulator and protruding toward said fixtures embedded in said insulator.

18. A puffer type gas circuit breaker comprising:

a metal vessel filled with an arc extinguishing gas;

an insulator disposed within said metal vessel and fixed at one end thereof to the inner surface of said metal vessel;

a stationary arcing contact;

conductive means fixedly attached to the other end of said insulator, for supporting said stationary arcing contact within said metal vessel;

a conductor connected to said supporting means within said metal vessel and extending to the exterior of said metal vessel in a direction orthogonal with respect to the central axis of said stationary arcing contact;

a movable arcing contact disposed within said metal vessel for making axial parting movement relative to said stationary arcing contact;

compressing means disposed within said metal vessel for compressing the arc extinguishing gas in response to the relative parting movement of said stationary and movable arcing contact;

an insulator nozzle disposed within said metal vessel and having an orifice, for guiding the compressed arc extinguishing gas puffed from said compressing means toward said stationary arcing contact through said orifice which has been disengaged from said stationary arcing contact, during the circuit breaking operation; and gas-shielding hood means disposed around said stationary arcing contact and said supporting means;

said supporting means including a mechanical supporting member mechanically supporting said insulator on said stationary arcing contact and an electrical conductive member electrically connecting said conductor to said stationary arcing contact.

19. A puffer type gas circuit breaker comprising:

a metal vessel filled with an arc extinguishing gas;

a pair of a stationary arcing contact and a movable arcing contact disposed within said metal vessel for making axial parting movement relative to each other;

compressing means disposed within said metal vessel for compressing the arc extinguishing gas in response to the relative parting movement of said stationary and movable arcing contacts;

an insulator nozzle disposed within said metal vessel and having an orifice, for guiding the compressed arc extinguishing gas puffed from said compressing means toward said stationary arcing contact through said orifice which has been disengaged from said stationary arcing contact, during the circuit breaking operation;

envelope means including annular shield means for substantially enveloping at least the free end of said stationary arcing contact, said shield means being maintained at the same potential level as that of said stationary arcing contact;

gas passage means formed in the side portion of said envelope means perpendicular to the axial length of said stationary contact; and gas-shielding hood means including a generally cylindrical member disposed around said gas passage means and having one end located downstream relative to the root portion of said stationary arcing contact with respect to the flowing direction of the arc extinguishing gas, for shielding the gas stream from flowing directly straight toward the inner surface of said metal vessel after the gas having been puffed from the orifice of said insulator nozzle and passed through said gas passage means.

20. A puffer type gas circuit breaker as claimed in claim 19, wherein said generally cylindrical member in said gas-shielding hood means is formed, at said one end located downstream relative to the root portion of said stationary arcing contact, with a gas shielding wall bent toward the central axis of said gas-shielding hood means.

21. A puffer type gas circuit breaker as claimed in claim 19, wherein said generally cylindrical member in said gas-shielding hood means has the other end located in close proximity to said annular shield means in said envelope means, and said the other end is maintained at substantially the same potential level as that of said stationary arcing contact.

22. A puffer type gas circuit breaker comprising:

a generally cylindrical metal vessel filled with an arc extinguishing gas;

an insulator disposed within said metal vessel and fixed at one end thereof to said metal vessel;

a connection conductor disposed within said metal vessel and fixed at one end thereof to the other end of said insulator;

a stationary arcing contact disposed within said metal vessel and fixed at one end thereof to the other end of said connection conductor;

a movable arcing contact disposed within said metal vessel for making axial parting movement relative to said stationary arcing contact;

compressing means disposed within said metal vessel for compressing the arc extinguishing gas in response to the relative parting movement of said stationary and movable arcing contacts;

an insulator nozzle disposed within said metal vessel and having an orifice, for guiding the arc extinguishing gas compressed by said compressing means toward said stationary arcing contact to cause the gas to act upon the arc jumping across said stationary and movable arcing contacts;

envelope means including annular shield means for substantially enveloping at least the free end of said stationary arcing contact, said shield means being maintained at the same potential level as that of said stationary arcing contact;

gas passage means formed in the side portion of said envelope means;

a conductor extending outward through said metal vessel in the radial direction of said metal vessel;

connecting means for electrically connecting said conductor to said connection conductor;

first gas-shielding hood means for shielding the gas stream from flowing directly straight toward the inner surface of said metal vessel after the gas having been puffed from the orifice of said insulator nozzle and passed through said gas passage means, said first gas-shielding hood means having an opening in one axial end surrounding said connecting means, the other end of said first gas-shielding hood means being slightly retreated from said annular shield means and arranged such that a passage is formed between said other end and said envelope means for discharging outward the inner pressure of said first gas-shielding hood means;

at least one strip conductor supporting said first gas-shielding hood means on said connection conductor and electrically connecting the former to the latter; and second gas-shielding hood means disposed adjacent to the connection between said connection conductor and said insulator for protecting said insulator against creeping discharge caused by the arc extinguishing gas stream discharged from said opening of said first gas-shielding hood means.

* * * * *